United States Patent [19]

Nottingham

[11] Patent Number: 4,573,654

[45] Date of Patent: Mar. 4, 1986

[54] MOUNTING STRUCTURE FOR A CRIB TOY

[75] Inventor: John Nottingham, Richmond Heights, Ohio

[73] Assignee: Meritus Industries, Inc., Florham Park, N.J.

[21] Appl. No.: 509,199

[22] Filed: Jun. 29, 1983

[51] Int. Cl.[4] ..... A47B 96/06; A47G 29/00

[52] U.S. Cl. ..... 248/231.1; 248/103; 248/126; 446/227

[58] Field of Search ..... 446/227, 113; 248/102, 248/103, 104, 126, 274, 282, 283, 295.1, 297.2, 298, 506, 231.1; 411/8, 81, 82, 83, 84, 85, 87, 88, 116, 119, 120, 166; 269/203

[56] References Cited

U.S. PATENT DOCUMENTS

| | | | |
|---|---|---|---|
| 1,023,259 | 4/1912 | Luce | 248/274 |
| 1,410,608 | 3/1922 | Schroth | 248/103 |
| 1,446,868 | 2/1923 | Baker | 446/124 X |
| 2,302,812 | 11/1942 | Stempel | 248/274 X |
| 2,738,152 | 3/1956 | Blackmore | 248/103 |

*Primary Examiner*—Mickey Yu

*Attorney, Agent, or Firm*—Lerner, David, Littenberg, Krumholz & Mentlik

[57] ABSTRACT

There is described a toy assembly for mounting a toy to a crib rail and the like and for alternatively supporting the toy on a self-supporting stand. The toy assembly is constructed from a mounting bracket which is adjustable for accommodating various constructions and sizes of crib rails, as well as to be converted into a self-supporting stand for mounting the toy thereto. The toy is removably secured to the mounting bracket so that it may be removed for independent play as desired by the child.

7 Claims, 7 Drawing Figures

FIG. 2
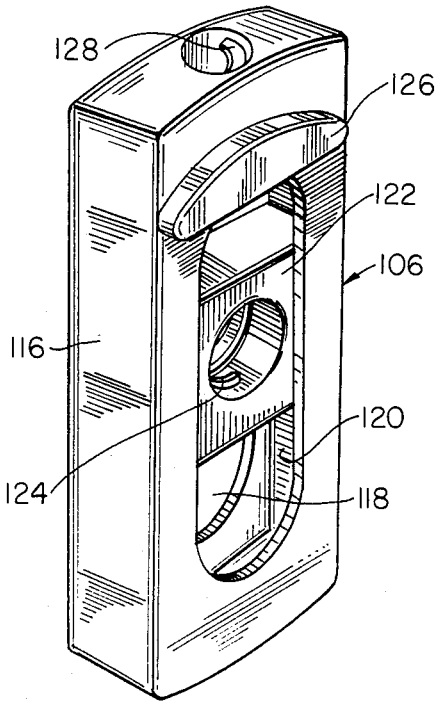
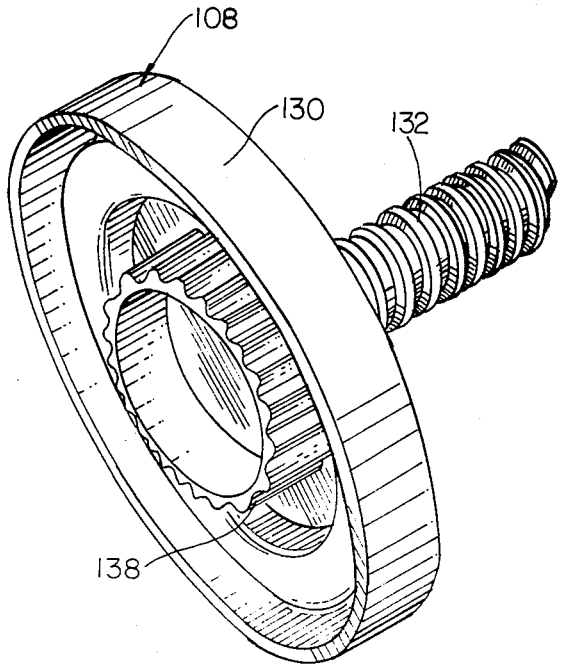
FIG. 4
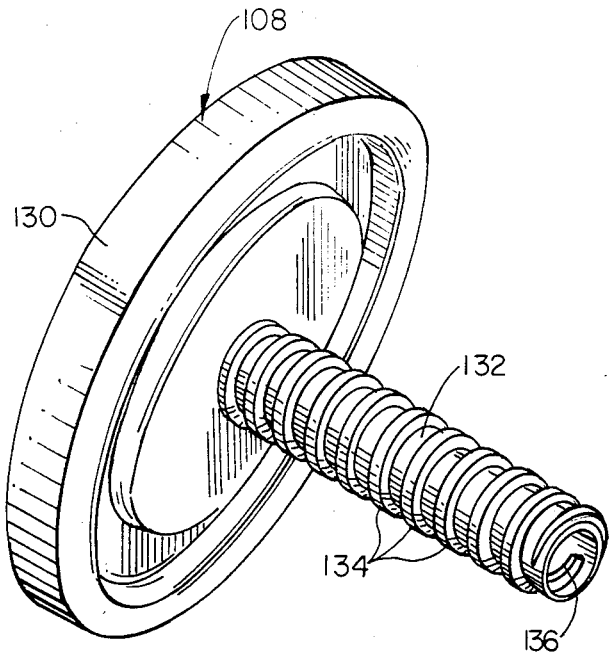
FIG. 3

MOUNTING STRUCTURE FOR A CRIB TOY

BACKGROUND OF THE INVENTION

The present invention relates in general to a toy assembly, and more particularly, to a crib toy assembly adapted for mounting a toy, plaything, ornament or the like to a crib rail and for alternatively supporting the toy on a self-supporting stand formed from the assembly when positioned on a table, dresser, floor or the like.

Crib toys have gained wide popularity as a result of their play value and ability to enhance the attention span of an infant. These crib toys are provided with suitable mounting brackets to permit the mounting of the crib toy to the top rail of a crib, playpen or the like. In order to accomodate the various sizes and constructions of such rails on both cribs and playpens, as well as other such infant confining devices, these mounting brackets have been constructed in various forms, for example, interlocking flexible straps, threaded T-shaped plugs, and the like. However, these mounting brackets due to their universal mounting characteristic have generally been awkward to use during both installation and removal of the crib toy. In addition, these mounting brackets have often been found either difficult or unsuitable for raising the crib toy upwardly as the infant gains the ability to reach and/or stand up in the crib, so as to position the crib toy in its optimum location with respect to the infant for maximum play value.

In addition to the foregoing, these prior art crib toys have had little value as the infant grows older and outgrows the need for a crib toy as such. As a consequence, these crib toys are often discarded after a relatively short useful lifespan, even though the crib toy is suitable for future use. Accordingly, it can be appreciated that there is an unsolved need for a toy assembly which can be readily mounted to the rail of a crib or playpen of various sizes and constructions in a convenient, simple and efficient manner. Likewise, there is an unsolved need for a toy assembly having an afterlife, that is, one suitable for use as the infant outgrows the play value of the crib toy when provided mounted to a crib or playpen.

SUMMARY OF THE INVENTION

It is broadly an object of the present invention to provide a toy assembly for mounting a toy to a crib rail and for alternatively supporting the toy on a self-supporting stand formed from the assembly which overcomes or avoids one or more of the foregoing disadvantages resulting from the use of the above-mentioned prior art crib toys, and which fulfills the specific requirements of such a toy assembly for use by an infant or older child. Specifically, it is within the contemplation of one aspect of the present invention to provide a toy assembly which facilitates the mounting of a toy to a crib rail of various sizes and constructions, as well as being alternatively suitable for supporting the toy on a self-supporting stand as the infant grows older to increase the play value and useful life of the toy.

A further object of the present invention is to provide a toy assembly having a detachable toy suitable for independent play by an infant or child.

In accordance with one embodiment of the present invention, there is provided a toy assembly for mounting a toy to a crib rail. The toy assembly is constructed of a first member having a stationary part and a movable part movable along one axis thereof, a second member having securing means for securing the members together adjacent opposite sides of the crib rail, the securing means having a portion attachable to the stationary part of the first member, wherein the movable part is movable relative to the stationary part and to the securing means, and attaching means for attaching a toy to one of the members.

Further in accordance with the above embodiment of the present invention, the movable part comprises a housing having an opening for receiving the stationary part therein, and the securing means is integrally formed with a central portion of the second member and has its longitudinal axis extending normal to a plane containing the second member.

Still further in accordance with the above embodiment of the present invention, the movable part is movable relative to the stationary part along the one axis of the first member and in a transverse direction relative to one axis of the securing means.

Still even further in accordance with the above embodiment of the present invention, the attaching means is constructed of a rod having one end attached to the housing and its other end attached to a toy.

In accordance with another embodiment of the present invention, there is provided a toy assembly for mounting a toy to a crib rail and for supporting the toy on a stand. The toy assembly is constructed of a first member, a second member having securing means for securing the first and second members together adjacent the crib rail, and attaching means for attaching the toy to the first member when the members are secured to the crib rail and to the second member when the second member is arranged as a stand.

Further in accordance with the last mentioned embodiment of the present invention, the attaching means is constructed of a rod having one end adapted to be alternatively connected to the first member and to the securing means.

Still further in accordance with the last mentioned embodiment of the present invention, the securing means is constructed of a first rod having an internally threaded end and the attaching means is constructed of a second rod having an externally threaded end, and wherein the externally threaded end of the second rod is threadingly received within the internally threaded end of the first rod to provide a stand for supporting a toy.

Still even further in accordance with the last mentioned embodiment of the present invention, the first member is provided with an internally threaded opening for threadingly receiving the externally threaded end of the second rod.

BRIEF DESCRIPTION OF THE DRAWINGS

The above description, as well as further objects, features and advantages of the present invention will be more fully understood by reference to the following detailed description of the presently preferred, but nonetheless illustrative, toy assembly in accordance with the present invention, when taken in conjunction with the accompanying drawings, wherein:

FIG. 2 is a perspective view of a first member included in the bracket illustrated in FIG. 1, such first member including a movable housing having an opening for receiving a stationary part and a protruding ridge adapted for engaging the top surface of the crib rail;

FIG. 3 is a perspective view showing the front construction of a second member of the bracket as illustrated in FIG. 1, such second member constructed from a circular planar base having an integrally formed threaded rod centrally positioned and extending outwardly normal to the plane containing the plane of the base;

FIG. 4 is a perspective view of the rear construction of the second member showing a ridged ring suitable for grasping by one's hand when securing the mounting bracket to a crib rail;

DETAILED DESCRIPTION

Figure 1:
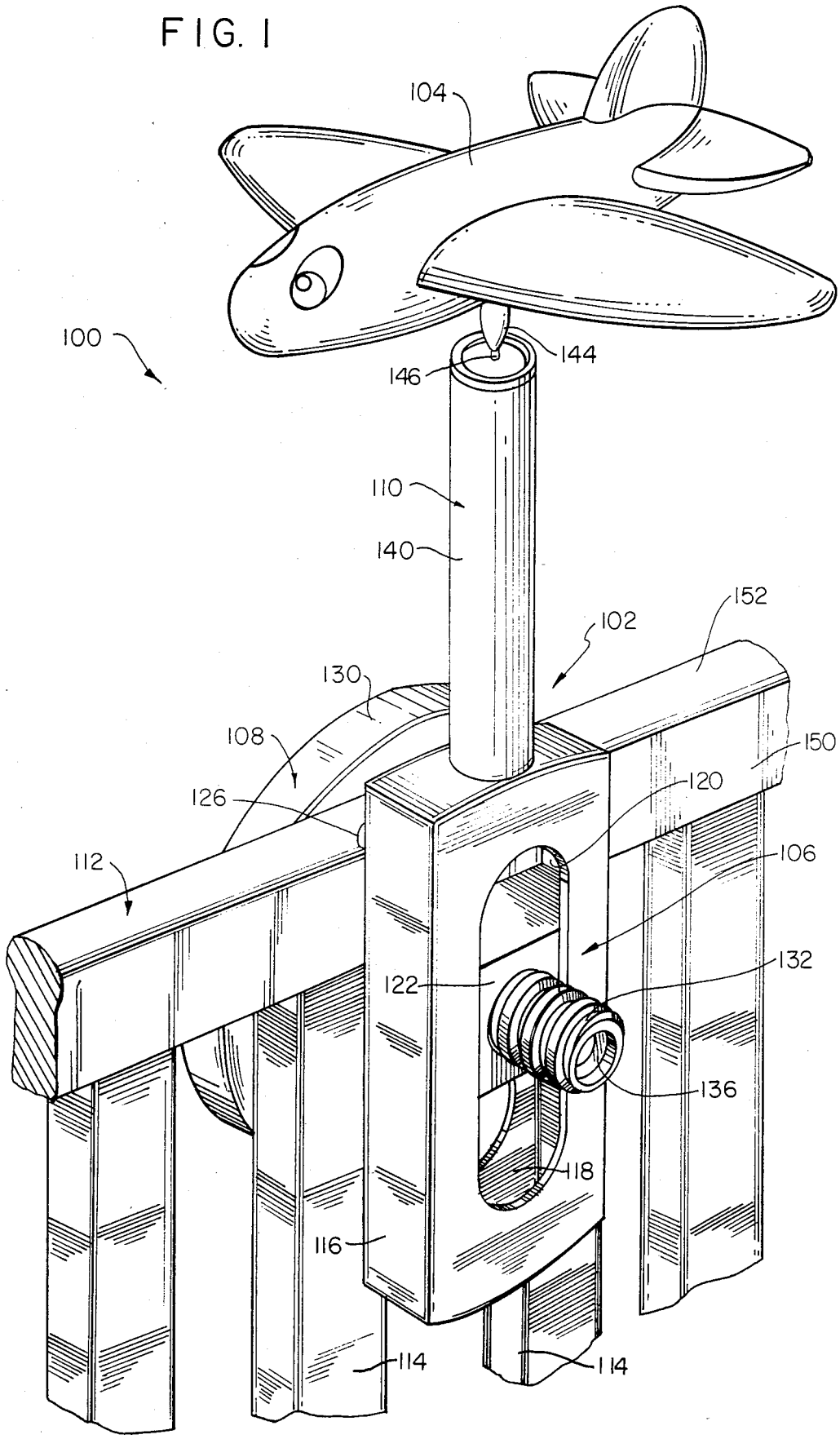
FIG. 1 is a perspective view showing the toy assembly of the present invention mounted to a crib rail by a mounting bracket suitable for accomodating various sizes and constructions of the crib rail, as well as providing for upward adjustment of the toy relative to the crib rail as dictated by the needs of the infant.

Referring generally to the drawings in which like reference characters represent like elements, there is shown in FIG. 1 a perspective view of a toy assembly 100 constructed from a mounting bracket generally designated by reference element 102 and a toy 104. The mounting bracket 102 is constructed from a first member 106, a second member 108 and an attachable rod 110. As shown, the mounting bracket 102 is secured to a crib rail 112 generally between a pair of adjacent upright slats 114. The toy 104 is accordingly positioned a predetermined distance above the crib rail 112 and generally out of the reach of the infant confined by the crib.

Referring to FIG. 2, the first member 106 is constructed from a generally rectangular part or movable housing 116 having an elongated central opening 118 and a circumscribing recess 120. A rectangular stationary part 122 having a centrally located internally threaded opening 124 is arranged within the opening 118 and captured therein by its lateral engagement with the circumscribing recess 120. A ridge 126 is provided projecting outwardly from one surface of the movable housing 116, adjacent one end of the elongated opening 118. An internally threaded opening 128 is centrally provided within one end of the movable housing 116, such end being adjacent the projecting ridge 126. As thus far described, the movable housing 116 of the first member 106 is adapted for movement in the nature of a sliding action along the longitudinal axis of the first member relative to the stationary part 122.

Referring now to FIGS. 3 and 4, the construction of the second member 108 will now be described. The second member 108 is constructed generally from a circular planar base 130 having an integrally formed connectable rod 132. The connectable rod 132 is centrally positioned on the base 130 and extends outwardly therefrom having its longitudinal axis arranged normal to the plane containing the plane of the base. The connectable rod 132 is provided with a plurality of external threads 134 and an internally threaded opening 136 at its free end. A ridged ring 138 is provided extending outwardly from the rear surface of the base 130, as shown in FIG. 4. The longitudinal axis of the ring 138 is arranged in alignment with the rotational axis of the base 130. Likewise, the longitudinal axis of the connectable rod 132 is arranged in alignment with the rotational axis of the base 130. Thus, rotation of the base 130 about its rotational axis by means of the ring 138 causes rotation of the connectable rod 132 about its longitudinal axis.

Figure 5:
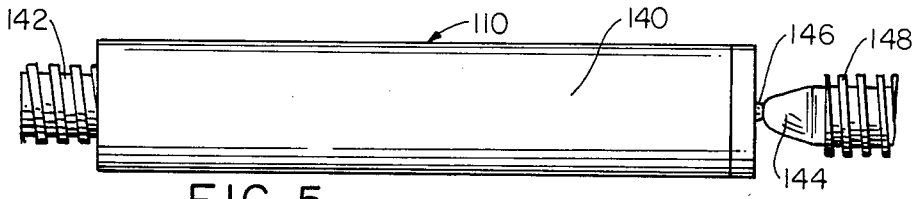
FIG. 5 is a side elevational view of the second or attachable rod for securing the toy to either the movable housing of the first member or to the threaded rod of the second member, such attachable rod having a pair of externally threaded ends.

Referring now to FIG. 5, the construction of the attachable rod 110 will now be described. The attachable rod 110 is constructed from a cylindrical rod 140 of predetermined length having an externally threaded end 142 and a connecting member 144 flexibly connected to the other end of the rod 140 by means of a rope or wire 146. The connecting member is provided with an externally threaded end 148. The threaded end 142 of the rod 140 is adapted to be threadingly received within the threaded opening 128 of the first member 106 or, in the alternative, to be threadingly received within the threaded opening 136 of the connectable rod 132. Similarly, the threaded end 148 of the rod 140 is adapted to be threadingly received within a threaded opening (not shown) within the toy 104 so as to flexibly attach the toy to the rod 140 by means of the rope or wire 146.

Figure 6:
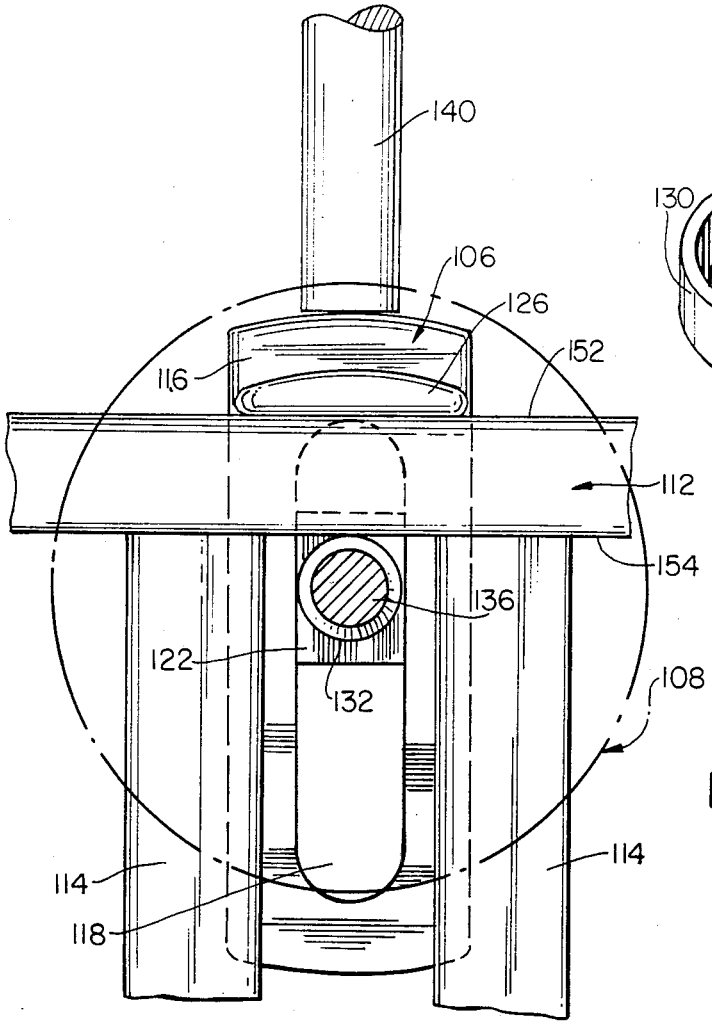
FIG. 6 is a rear elevational view showing the mounting of the mounting bracket to a crib rail with the protruding ridge of the first member abutting the top surface of the crib rail.

The arrangement of the toy assembly 100 for securing a toy 104 to a crib rail 112 will now be described with reference to FIGS. 1 and 6. Initially, the first member 106 is positioned adjacent the vertical surface 150 of the crib rail 112 in alignment with the opening provided between the pair of adjacent slats 114. The first member 106 is specifically arranged such that the ridge 126 engages the top surface 152 of the crib rail 112, as best shown in FIG. 6. The engagement of the ridge 126 with the top surface 152 of the crib rail 112 provides the toy assembly 100 with increased stability by preventing its being rotated in either a clockwise or counterclockwise direction during use. As shown in FIG. 6, the movable housing 116 of the first member 106 is slid about the stationary part 122, which stationary part is retained within the elongated opening 118, such that the internally threaded opening 124 of the stationary part is arranged underlying the bottom surface 154 of the crib rail 112. The second member 108 is positioned on the opposite side of the crib rail 112 such that the connectable rod 132 is in alignment with the internally threaded opening 124 of the stationary part 122. In this arrangement, the connectable rod 132 is threadingly received within the threaded opening 124 of the stationary part 122 by rotation of the second member 108 about its axis of rotation by grasping the ridged ring 138 and rotating the base 130 in the appropriate clockwise or counterclockwise direction. Upon further rotation of the first member 108 about its axis of rotation, the connectable rod 132 is increasingly received within the threaded opening 124 of the stationary part 122 until the first and second members are secured together adjacent opposite sides of the crib rail 112 and slats 114. As thus far described, it can be appreciated that the mounting bracket 102 is now securely attached to the crib rail 112 by means of the first and second members 106, 108 being drawn together by the connectable rod 132.

As shown in FIG. 6, it can be further appreciated that the mounting bracket 102 is suitable for accomodating various size crib rails 112. For example, where the width of the crib rail 112 is greater than that disclosed in FIG. 6, it is merely required that the movable housing 116 be slid upwardly about the stationary part 122 so as to position the threaded opening 128 of the stationary part underlying the bottom surface 154 of the crib rail. The mounting bracket 102 is therefore considered to be a universal mounting bracket suitable for use with crib rails of various sizes and constructions. With the first and second members 106, 108 of the mounting bracket 102 being firmly secured to the crib rail 112 and slats 114, the toy 104 may now be attached to the first member 106 by means of the attachable rod 110. The toy 104 is removably secured to the rod 140 by threading the threaded end 148 of the connecting member 144 into a suitable threaded opening (not shown) within the toy. However, it can be appreciated that other means for attaching the toy 104 to the attachable rod 110 may be provided, such as hooks, clips, and the like. The attachable rod 110 is attached to the first member 106 by threading the threaded end 142 of the rod 140 into the threaded opening 128 of the movable housing 116 of the first member 106. It is also contemplated that the attachable rod 110 may be secured to the second member 108 using a suitable threaded opening in a similar manner, if desired.

The toy 104 is attached to the attachable rod 110 by means of the flexible rope or wire 146 and connecting member 144. The flexible rope or wire 146 permits the toy 104 to tilt and pivot about the rod 140 to increase its play value to an infant. Further, as the toy 104 is removably attached to the attachable rod 110, the toy may be removed therefrom and utilized independent of the mounting bracket 102, such as within the crib or along the floor. This feature of the present invention allows the toy 104 to have increased play value by being suitably attached to the crib when the user is an infant, and later to be used as a separate toy independent of the mounting bracket 102 when the infant grows older and outgrows the need for an attached crib toy. In addition to attaching a toy 104 to the attachable rod 110, it can be appreciated that other playthings such as ornaments, novelty items, pinwheels and the like may be attached to the crib rail 112 using the mounting bracket 102 in accordance with the present invention. Also, the relative position of the toy 104 above the crib rail 112 can be adjusted either upwardly or downwardly as desired by the appropriate sliding of the movable housing 116 about the stationary part 122. In this regard, as the infant grows older and begins to reach upwardly or stand within the crib, the relative height of the toy 104 with respect to the crib rail 112 may be varied as desired. Although it is preferred that the ridge 126 be engaged by the top surface 152 of the crib rail 112, this arrangement is not essential to the present invention and a suitable space may be provided therebetween to permit the upward movement of the toy 104 by sliding the movable housing 116 upwardly to its uppermost position.

Figure 7:
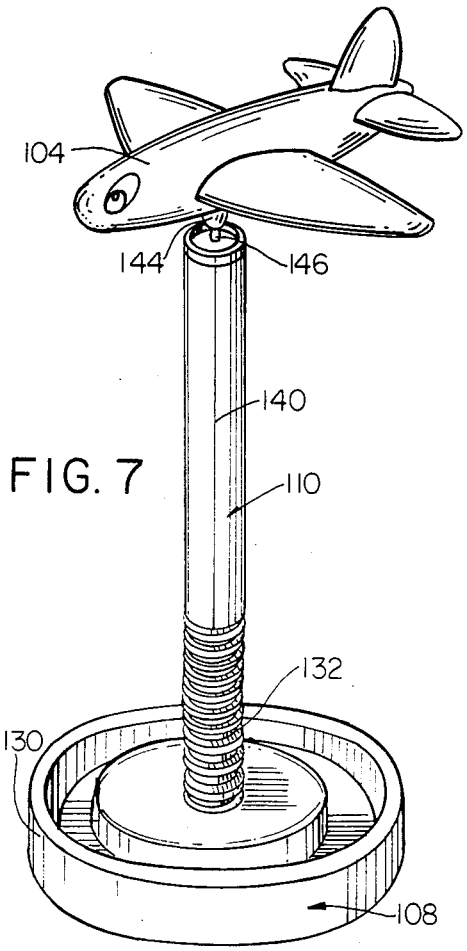
FIG. 7 is a perspective view of the toy assembly provided as a self-supporting stand having the toy attached to the base of the second member by the attachable rod being releasably secured to the free end of the threaded rod of the second member.

Turning now to FIG. 7, there is shown an alternative use of the mounting bracket 102 in accordance with another aspect of the present invention. As previously described, the mounting bracket 102 is suitable for attaching a toy 104 to the crib rail 112. As the infant outgrows the necessity of a crib toy, or when it is no longer desired to maintain the toy secured to the crib rail, the mounting bracket 102 can be converted to a self-supporting stand. In this regard, the second member 108 is positioned with the circular planar base 130 supported by the surface of a table, floor, dresser or the like and having the connectable rod 132 extending upwardly. The base 130 provides a sturdy support for a stand to which the toy 104 can be attached. The toy 104 is connected to the second member 104 by means of the attachable rod 110. The rod 140 is attached to the connectable rod 132 by threadingly receiving the threaded end 142 of the rod 140 within the threaded opening 136 of the connectable rod. In this manner, the second member 108 and attachable rod 110 provide a self-supporting stand to which the toy 104 is removably attached. The stand and attached toy 104 may be positioned within the child's room as desired, in the form of a decorative fixture, as well as being able to remove the toy therefrom for independent play.

In accordance with the second aspect of the present invention, there has been described a toy assembly 100 for alternatively mounting a toy 104 to a crib rail 112 and for supporting the toy on a stand. The toy assembly 100 is constructed of a first member 106, a second member 108 having an integrally formed rod 132 extending normal thereto for securing the first and second members together adjacent opposite sides of a crib rail 112, and an attachable rod 110 having a toy 104 attached to one end thereof for attaching the toy alternatively to the first member by the other end of the attachable rod when the first and second members are secured to the crib rail and to attach the toy to the free end of the integrally formed rod of the second member when the second member is arranged as a stand on a substantially horizontal support.

Although the invention herein has been described with reference to particular embodiments, it is to be understood that these embodiments are merely illustrative of the principals and application of the present invention. For example, although the present invention has been described as suitable for securing a toy to a crib rail, it should be appreciated that the toy can be secured to the rail of a playpen or other such enclosure for an infant or child. Accordingly, the present invention provides the means for securing a toy to a crib rail, as well as to mount the toy to an independent support stand, including the ability to remove the toy for independent play. It is therefore to be understood that numerous modifications may be made in the illustrative embodiments in that other arrangements may be devised without departing from the spirit and scope of the present invention as defined by the appended claims.

What is claimed is:

1. A toy assembly for mounting a toy to a crib rail and for supporting said toy on a stand, said assembly comprising a first member, a second member having securing means for securing said first and second members together adjacent said crib rail, and attaching means for attaching said toy to said first member when said first and second members are secured together and to said second member when said second member is arranged as a stand, said securing means comprising a first rod having an internally threaded end and said attaching means comprising a second rod having an externally threaded end, wherein said externally threaded end of said second rod is threadingly received within said internally threaded end of said first rod to provide said stand for supporting a toy.

2. The assembly of claim 1 wherein said second member includes a base for supporting said toy on a substantially horizontal surface when said attaching means is connected to said securing means.

3. The assembly of claim 1 wherein said externally threaded end of said second rod is alternatively connected to said first member and to said securing means.

4. The assembly as set forth in claim 1 wherein said stand comprise said second member, said securing means, and said attaching means.

5. The assembly of claim 1 wherein said first member includes an internally threaded opening for threading receiving said externally threaded end of said second rod.

6. The assembly of claim 1 wherein said first rod is integrally formed at a central portion of said second member and having its longitudinal axis extending normal to a plane containing said second member.

7. The assembly of claim 1 wherein said first rod further including an externally threaded free end and said first member having an internally threaded opening for threadingly receiving said externally threaded free end of said securing means.

* * * * *